United States Patent [19]

Sone et al.

[11] Patent Number: 4,679,953

[45] Date of Patent: Jul. 14, 1987

[54] PAPER FEEDING AND EJECTING DEVICE FOR A PRINTING APPARATUS

[75] Inventors: Masakazu Sone; Takeshi Nakajima, both of Kanagawa, Japan

[73] Assignee: Sony Corporation, Tokyo, Japan

[21] Appl. No.: 791,204

[22] Filed: Oct. 24, 1985

[30] Foreign Application Priority Data

Oct. 27, 1984 [JP] Japan ..... 59-162691[U]

[51] Int. Cl.[4] ..... B41J 11/58

[52] U.S. Cl. ..... 400/625; 400/120; 400/208; 400/527.2; 400/528; 400/629; 400/636; 400/708; 271/3; 271/119; 271/902

[58] Field of Search ..... 400/120, 208, 525, 526, 400/527, 527.1, 527.2, 528, 550, 551, 568, 569, 624, 625, 629, 636, 636.2, 708; 271/3, 3.1, 119, 902; 101/409

[56] References Cited

U.S. PATENT DOCUMENTS

| | | | |
|---|---|---|---|
| 2,707,545 | 5/1955 | Dreher et al. | 400/526 |
| 3,908,981 | 9/1975 | Naroff | 271/3 |
| 3,966,187 | 6/1976 | Beduchaud et al. | 271/902 X |
| 4,089,402 | 5/1978 | Hyland et al. | 400/625 |
| 4,437,656 | 3/1984 | Onoda et al. | 271/119 X |
| 4,438,915 | 3/1984 | Akamatsu et al. | 271/902 X |
| 4,489,931 | 12/1984 | Costa et al. | 400/629 X |
| 4,543,004 | 9/1985 | Brandenburg et al. | 400/527.2 X |
| 4,579,328 | 4/1986 | Hagihara et al. | 271/119 X |

FOREIGN PATENT DOCUMENTS

| | | | |
|---|---|---|---|
| 77187 | 7/1919 | Fed. Rep. of Germany | 271/3 |
| 3130812 | 6/1982 | Fed. Rep. of Germany | 400/551 |
| 0211479 | 12/1983 | Japan | 400/636.2 |
| 0171676 | 9/1984 | Japan | 400/526 |

OTHER PUBLICATIONS

IBM Technical Disclosure Bulletin, "Document Separator", Sobey, vol. 26, No. 4, Sep. 1983, pp. 1770–1771.

IBM Technical Disclosure Bulletin, "Paper-Aligning Apparatus", Hunt, vol. 27, No. 1A, Jun. 1984, pp. 216–217.

IBM Technical Disclosure Bulletin, "Feed Extender for Sheet Feeder", Dunning, vol. 27, No. 3, Aug. 1984, pp. 1597–1598.

*Primary Examiner*—Ernest T. Wright, Jr.

*Attorney, Agent, or Firm*—Lewis H. Eslinger; Alvin Sinderbrand

[57] ABSTRACT

In a paper feeding and ejecting device for a printing apparatus, a sheet of paper is fed by a paper feeding roller from the top of a stack of paper sheets in a magazine through a feeding guide to a gripping assembly on the peripheral surface of a platen which is rotated in one direction during printing and in the opposite direction during ejecting of a printed sheet through an ejecting guide to ejecting rollers. The feeding roller and the ejecting rollers are driven by a single reversible drive motor at suitable times during the operating cycle. The feeding guide and the ejecting guide are separated from each other at the platen so that the feeding of a sheet to the platen will not interfere with the ejecting of a printed sheet. At the completion of each operating cycle, the feeding roller is accurately located at a standby position without requiring the use of a control sensor therefor.

12 Claims, 20 Drawing Figures

PAPER FEEDING AND EJECTING DEVICE FOR A PRINTING APPARATUS

BACKGROUND OF THE INVENTION

1. Field of the Invention

This invention relates generally to a printing apparatus in which sheets of paper successively removed from a stack thereof are printed while individually wrapped about a rotatable platen, and the invention is more particularly directed to a paper feeding and ejecting device for such apparatus.

2. Description of the Prior Art

In an existing paper feeding and ejecting device for a printing apparatus, a rotatable platen has a cutout extending across a peripheral surface to define a chucking seat, and a gripping assembly for securing on such seat the leading end portion of a paper sheet manually fed to the platen over a support plate extending to the surface of the platen at the top of the latter. After a sheet of paper has been thus fed to the platen, a push-button is actuated to provide a printing command signal by which the gripping assembly is made operative to secure the leading end of the sheet to the platen at the chucking seat of the latter, and the platen is rotated in one direction for winding or wrapping the sheet thereon. During such rotation of the platen, the sheet wrapped thereon is carried past a printing position at which, for example, a thermal head acts on the paper sheet through an interposed ink sheet or web for effecting thermal printing of the paper sheet on the platen. Upon completion of the printing operation, the paper gripping assembly is moved to its released position, and the platen is rotated for ejecting the printed paper sheet therefrom. Finally, the ejected paper sheet is manually removed from the printing apparatus.

In the above described existing paper feeding and ejecting device for a printing apparatus, the paper feeding and ejecting involve manual operations, and, therefore, are relatively troublesome and not uniformly effected. Further, since the paper feeding and ejecting occur through the same guide passage, the reduction of the time required for a complete printing cycle is limited in that the paper sheet to be printed can be inserted into the guide passage only after a previously printed paper sheet has been fully ejected or removed from such passage.

Consideration has been given, by persons having an obligation of assignment to the owner of the present invention at the time the latter was made, to overcoming the previously stated problems by providing apparatus including separate paper feeding and ejecting guide passages, a paper feeding device automatically operative to feed paper to be printed through the feeding guide passage to the rotary platen, and a paper ejecting device by which the paper which has been printed is automatically ejected through the ejecting guide passage. In such apparatus having separate paper feeding and ejecting guide passages, two separate motors have been required for driving the paper feeding device and the paper ejecting device, respectively, independently of each other, and this results in undesirable complications and relatively high cost of the apparatus. Further, when the paper to be printed is automatically fed by a paper feeding device in the form of a roller, the apparatus is susceptible to jamming by reason of inaccurate timing of the operation of the paper feeding device relative to other operations of the apparatus, such as, rotation of the platen in the course of a printing operation. In order to avoid the undesirable consequences of timing errors, additional sensors are required for accurately controlling successive movements of the paper feeding device, but this also results in an undesirably complicated structure of relatively high cost.

OBJECTS AND SUMMARY OF THE INVENTION

Accordingly, it is an object of this invention to provide a paper feeding and ejecting device for a printing apparatus which avoids the previously mentioned disadvantages of the previously proposed devices More particularly, it is an object of this invention to provide a paper feeding and ejecting device for a printing apparatus which is capable of the high speed, automatic feeding and ejecting of successive paper sheets, so as to make possible a relatively high printing speed in a relatively simple and inexpensive apparatus.

Another object is to provide a paper feeding and ejecting device for a printing apparatus, as aforesaid, in which high speed paper feeding and ejecting are automatically effected by means of a device using a single motor therefor, and further in which no sensor is required for detecting movements of the paper feeding device.

In accordance with an aspect of this invention, a paper feeding and ejecting device for a printing apparatus comprises a platen rotatable in a predetermined direction for winding or wrapping a sheet of paper therearound during printing of the sheet, a magazine for storing a stack of paper sheets, feeding roller means disposed above the magazine and being rotatable for feeding a sheet of paper from the top of the stack toward the rotatable platen, feeding guide means extending between the magazine and the platen for guiding the sheet of paper being fed by the feeding roller means in a feeding path leading to the platen at a predetermined location on the peripheral surface of the platen, ejecting roller means linked with the feeding roller means and being operative for ejecting a sheet of paper after the printing thereof, and ejecting guide means for guiding the sheet of paper to be ejected to the ejecting roller means from the platen, such ejecting guide means having an entrance adjacent the peripheral surface of the platen at a location thereon spaced in said predetermined direction of rotation of the platen during printing from the predetermined location to which the feeding path extends.

In a preferred embodiment of the invention, the platen is provided with drive means therefor including a platen drive motor operative to rotate the platen in its predetermined direction during printing and in the opposed direction during ejecting of a paper sheet which has been printed.

Further, in the preferred embodiment of this invention, a reversible roller drive motor is provided along with means for rotating the ejecting roller means from the roller drive motor, and means including a one way clutch for rotating the feeding roller means from the reversible roller drive motor only in response to operation of the latter in one of its reversible directions.

The above, and other objects, features and advantages of the invention, will be apparent in the following detailed description of an illustrative embodiment of the invention which is to be read in connection with the accompanying drawings wherein the same reference numerals are used to identify the same parts or elements in the several views of the drawings

DETAILED DESCRIPTION OF A PREFERRED EMBODIMENT

Figure 1:
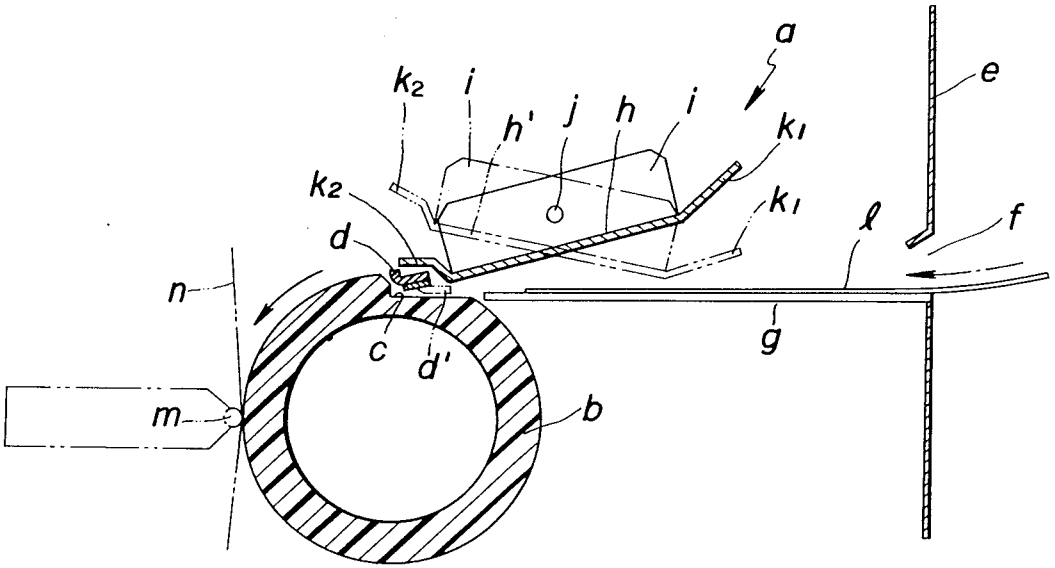
FIG. 1 (PRIOR ART)
FIG. 1 is a diagrammatic sectional view showing only those elements of a paper feeding and ejecting device for a printing apparatus according to the prior art which are necessary for understanding of the operation thereof.

In order that the problems solved by the present invention may be fully understood, a paper feeding and ejecting device a for a printing apparatus according to the prior art will be initially described with reference to FIG. 1. Such printing apparatus a is shown to include a rotatable platen b having a cutout c of substantially L-shaped crosssection extending axially across the peripheral surface of platen b to define a chucking seat. In an initial or standby rotary position of platen b, chucking seat c thereof is located at the top of the platen b, as shown in FIG. 1. A paper gripping or chuck member d is mounted on platen b adjacent chucking seat c for movement between a released position shown in full lines, in, FIG. 1, and in which paper gripping member d is spaced upwardly from the bottom of seat c, and an engaged or gripping position d′ shown in dot-dash lines on FIG. 1, and in which paper gripping member d is operative for securing a leading end portion of a paper sheet 1 against the bottom of chucking seat c.

The printing apparatus a according to the prior art is further shown to have its rotary platen b disposed within a housing having a front panel e formed with a paper insertion and ejection window or slot f extending laterally above a fixed horizontal paper support plate g which is directly rearwardly from the lower edge of slot f at a level corresponding to the bottom of the chucking seat c in the initial or stand-by position of platen b. A paper feeding-ejecting guide plate h is disposed above paper support plate g at the portion of the latter adjacent platen b. Flanges i extend upwardly from the opposite ends of paper guide plate h and are pivotally supported on a laterally extending axle j so that guide plate h is rockable about axle j between a first inclined paper feeding position shown in full lines in FIG. 1 and an oppositely inclined paper ejecting position indicated in dot-dash lines at h′ in FIG. 1. The laterally extending edges of guide plate h have extensions $k_1$ and $k_2$, respectively, directed obliquely upward therefrom.

The paper guide plate h is located and dimensioned so that, in its paper feeding position shown in full lines in FIG. 1, paper guide plate h is inclined downwardly relative to support plate g in the direction toward chucking seat c and will have its obliquely directed extension $k_2$ in overlapping relation to sheet gripping member d in the released position of the latter. It will be appreciated that, in such paper feeding position of guide plate h, the paper guide passage between plates g and h tapers in height in the direction toward platen b. On the other hand, in the sheet ejecting position of the guide plate indicated in dot-dash lines at h′ in FIG. 1, the guide plate h is oppositely inclined in respect to support plate g, that is, guide plate h′ is downwardly inclined in the direction toward its extension $k_1$ so that the extension $k_2$ along the opposite edge of plate h′ will be spaced a relatively large distance upwardly from the surface of platen b and the paper guide passage between plates g and h tapers in the direction away from platen b.

In operating the known paper feeding and ejecting device shown in FIG. 1, a paper sheet 1 which is to be printed is manually inserted through slot f so as to be slidably displaced on support plate g until the leading end edge of sheet 1 is brought into contact with the locating or radially directed surface of seat c on platen b which is then located in its initial position. In response to a print command occurring when the leading end edge of sheet 1 has been contacted with the locating surface of seat c, paper gripping member d is suitably shifted from its released position to its engaged or gripping position shown at d′ so that the leading end edge portion of sheet 1 is gripped or chucked on platen b. Then, platen b is rotated in the direction of the arrow shown in full lines in FIG. 1, that is, in the printing direction. During such rotation of platen b, paper sheet 1 is wrapped thereabout and moved past a printing position at which a thermal head m acts on the paper sheet 1 through an ink sheet or web n for effecting the thermal or heat transfer of a desired pattern of ink or dye to the paper sheet 1 for printing the latter. It will be appreciated that, during the manual feeding of the paper sheet 1 over support plate g, guide plate h remains in its paper feeding position shown in full lines in FIG. 1, and thereby cooperates with support plate g to ensure the guiding of the leading end edge portion of paper sheet 1 onto seat c and under the paper gripping member d.

Upon completion of a printing operation, guide plate h is suitably moved or rocked to its paper ejecting position indicated at h' and platen b is then rotated in the clockwise direction, that is, in the direction opposed to the arrow shown in full lines in FIG. 1. During such rotation of platen b in the clockwise or paper ejecting direction, the trailing end edge portion of the paper sheet 1 wound about platen b, that is, the end edge of the sheet 1 remote from the edge secured by gripping member d, tends to deflect radially outward away from the surface of platen b. However, guide plate h' in its paper ejecting position provides a paper guiding passage which funnels down in the direction away from platen b so that the free end edge of the paper sheet 1 being ejected is securely deflected downwardly by the extension $k_2$ of guide plate h' and made to travel through the paper guiding passage. Thus, as platen b is rotated in its paper ejecting direction, the printed paper sheet 1 is propelled through the paper guiding passage over support plate g and out of slot f. Finally, when platen b has been returned to its initial or standby position shown in full lines in FIG. 1, sheet gripping member d is disengaged or released and the end portion of the paper sheet 1 then projecting out of slot f can be manually pulled for removing the entire paper sheet 1 from the printing apparatus.

Since the paper feeding and ejecting device of the prior art described above with reference to FIG. 1 involves manual operations for feeding and ejecting the successive paper sheets 1, such operations are necessarily troublesome. Furthermore, since the feeding and ejecting of the paper sheet 1 is effected through the same paper guiding passage defined between support plate g and guide plate h, the speed or frequency with which a full printing cycle can be effected is necessarily limited. In other words, a new paper sheet 1 cannot be fed to the surface of platen b through the guide passage between plates g and h until the previously printed paper sheet 1 has been completely removed through the same guide passage.

Figure 2:
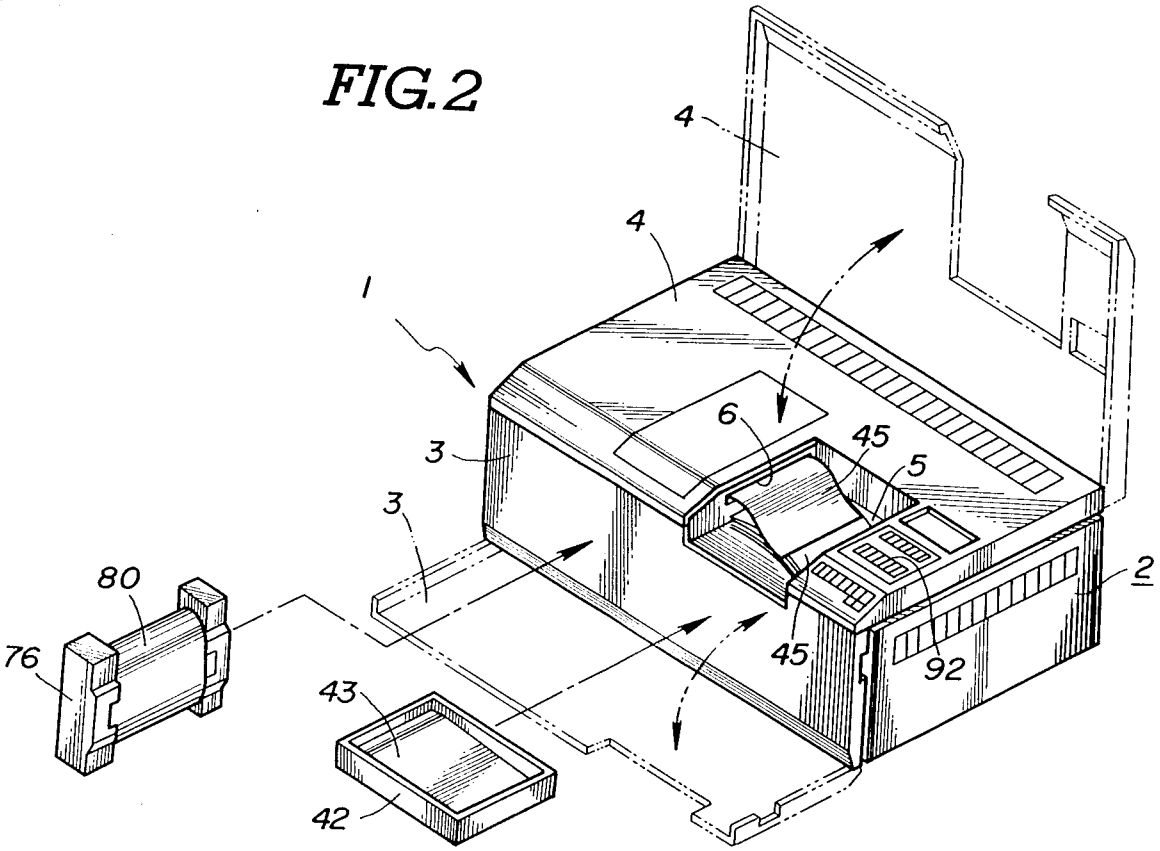
FIG. 2 is an exploded perspective view of a thermal printing apparatus of a type that can be desirably provided with a paper feeding and ejecting device according to an embodiment of this invention, and in which a tray for holding a stack of paper and an ink ribbon cassette are shown separated from the housing of the printing apparatus.

The foregoing problems are avoided in a paper feeding and ejecting device according to the present invention which may be applied, as shown in FIG. 2, to a thermal printer or printing apparatus 1 having a cabinet 2. Cabinet 2 desirably has a front panel 3 and a top panel 4 which are pivotally mounted so as to be movable between closed positions shown in full lines and opened positions shown in dot-dash lines in FIG. 2. A compartment 5 for receiving printed sheets of paper 45 is recessed in the upper portion of cabinet 2 adjacent front panel 3, and a paper ejecting slot 6 opens through one side of recessed compartment 5 for discharging successive printed paper sheets 45 into the latter.

A platen 7 (FIG. 3) is provided on a shaft 8 which has its opposite end portions rotatably supported in two main frame members 9 (FIG. 4) disposed within cabinet 2 at the front and back of the latter. A timing pulley 10 is fixed on the front end portion of platen shaft 8 and a platen drive motor 11 (FIGS. 3 and 5) is mounted within cabinet 2 below platen 7 and has an output shaft 12 on which a drive pulley 13 is secured for driving a belt 14 extending around pulleys 10 and 13. Platen drive motor 11 is reversible so as to be capable of causing rotation of platen 7 in a "printing direction", that is, the counterclockwise direction as viewed in FIG. 5, or in a "paper ejecting direction", that is, the clockwise direction in FIG. 5.

The peripheral surface of platen 7 is provided with a paper chucking seat 15 in the form of a cutout extending axially across platen 7 and being of substantially L-shaped cross-section so as to define orthogonally related surfaces **15*a* and 15*b*. More particularly, the surface 15*b* is relatively narrow and extends in a plane passing radially through the axis of rotation of platen 7 to define a paper stop or locating surface, while the surface 15*a*** is relatively wide and defines a paper chucking surface.

Figure 4:
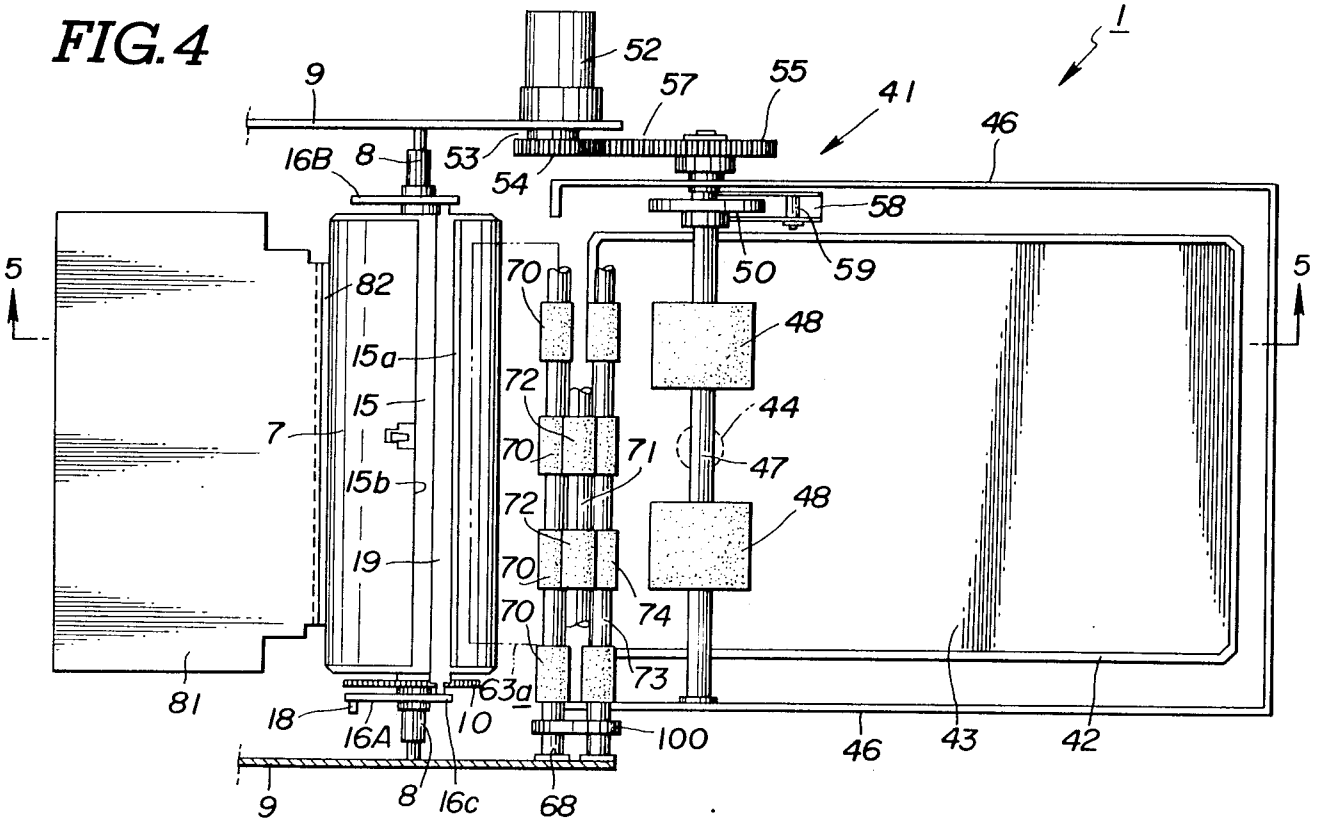
FIG. 4 is a top plan view of the paper feeding and ejecting device of FIG. 3, but with its feeding and ejecting guides removed for more clearly illustrating elements thereunder.

Support arm members 16A and 16B of a paper chucking or gripping assembly are pivotally mounted on platen 7 adjacent the front and rear end surfaces, respectively, of the platen 7 (FIG. 4). As shown particularly in FIG. 7, the front support arm member 16A is generally Z-shaped and includes an intermediate portion **16*a* pivotally mounted, intermediate its ends, on a pivot pin 17 projecting from the front end surface of platen 7 approximately midway between platen shaft 8 and paper chucking seat 15. Extending from the opposite ends of intermediate portion 16*a* of arm member 16A are an actuating arm portion 16*b* which is directed toward a location on the circumference on platen 7 approximately diametrically opposed to the location of seat 15, and an oppositely directed arm portion 16*c* which terminates adjacent seat 15. The other or rear support arm member 16B is shaped similarly to the portions 16*a* and 16*c* of member 16A, that is, it does not include the actuating arm portion 16*b*. Further, support arm member 16B is mounted similarly to the support arm member 16A, but at the rear end surface of platen 7. A control pin 18 projects from the free end of actuating arm portion 16*b* on support arm member 16A** for a purpose hereinafter described in detail.

A paper gripping or chuck member 19 (FIG. 3) is in the form of an elongated strip or bar extending parallel to the axis of platen 7 adjacent chuck surface **15*a* of seat 15. Two elongated pressure members 20, for example, of rubber or other material having a high coefficient of friction in respect to paper, are secured along the surface of gripping member 19 facing toward chuck surface 15*a*. The opposite ends of gripping member 19 are formed with inwardly directed flanges 21 which are suitably secured to the free ends of arm portions 16*c* of support arm members 16A and 16B**.

Figure 7:
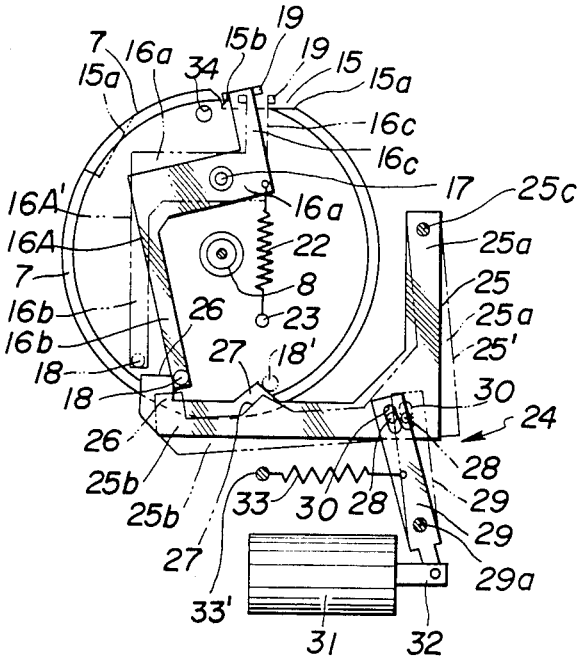
FIG. 7 is an enlarged side elevational view showing an apparatus for gripping each paper sheet to the rotary platen of the printing apparatus, and of a control mechanism for such paper gripping assembly.

Tension springs 22, only one of which appears in FIG. 7, are connected between intermediate portions **16*a* of support arm members 16A and 16B and anchor pins 23 secured to the front and rear end surfaces, respectively, of platen 7. Such springs 22 urge support arm members 16A and 16B in the clockwise direction, as viewed on FIG. 7, about the respective pivot pins 17 so that paper gripping member 19 is urged in the radially inward direction, that is, toward the axis of platen 7, to an engaged or gripping position in which pressure members 20 are urged against chuck surface 15*a***.

A control mechanism 24 for the paper chuck or gripping member 19 is shown in FIG. 7 to include a substantially L-shaped control lever 25 having substantially vertical and horizontal arm portions 25*a* and 25*b*, respectively. The upper end of vertical arm portion 25*a* is pivotally supported on a pin 25*c* carried by frame member 9 for movement of control lever 25 between a normal first position indicated in full lines on FIG. 7 and a second or released position shown in dot-dash lines at 25'. In the normal or first position of control lever 25, an upwardly directed extension 26 at the free end of horizontal arm portion 25*b* extends into the orbit or circular path of pin 18 rotating with platen 7. More particularly, with control lever 25 in its normal or first position and platen 7 in its initial or standby position with seat 15 at the top thereof, extension 26 engages pin 18 on actuating arm portion 16*b* of support arm member 16A and causes angular displacement of arm member 16A in the counterclockwise direction, as viewed on FIG. 7, for moving chuck or gripping member 19 to its released position shown in full lines. Horizontal arm portion 25*b* of control lever 25 is further formed with an upwardly directed, triangular cam-like projection 27 at its middle portion. The cam-like projection 27 is dimensioned to also project into the orbit of pin 18 when control lever 25 is in its normal or first position so that, as hereinafter described in detail, cam-like like projection 27 engages pin 18 for at least partially releasing chuck or gripping member 19 during a sheet ejecting operation.

An actuating pin 28 is secured to control lever 25 adjacent the middle thereof, and an operating lever 29 is pivotally mounted, intermediate its ends, on a pin 29*a* and has a slot 30 in one end portion receiving pin 28. The end of operating lever 29 remote from control lever 25 is pivotally connected to an armature 32 of a plunger or solenoid 31. A spring 33 is connected between operating lever 29 and a fixed anchor 33' on the frame member 9 for urging operating lever 29 in the counterclockwise direction about pivot pin 29*a*, as viewed in FIG. 7, thereby to urge control lever 25 to its normal or first position shown in full lines so long as solenoid 31 is not energized. On the other hand, when solenoid 31 is energized to retract its armature 32, controlling lever 29 is turned in the clockwise direction and, through the connection provided by pin 28 in slot 30, control lever 25 is moved to its second or released position shown in dot-dash lines at 25' in FIG. 7, for withdrawing extension 26 and cam-like projection 27 of arm portion 25*b* from the orbit of pin 18.

Figure 3:
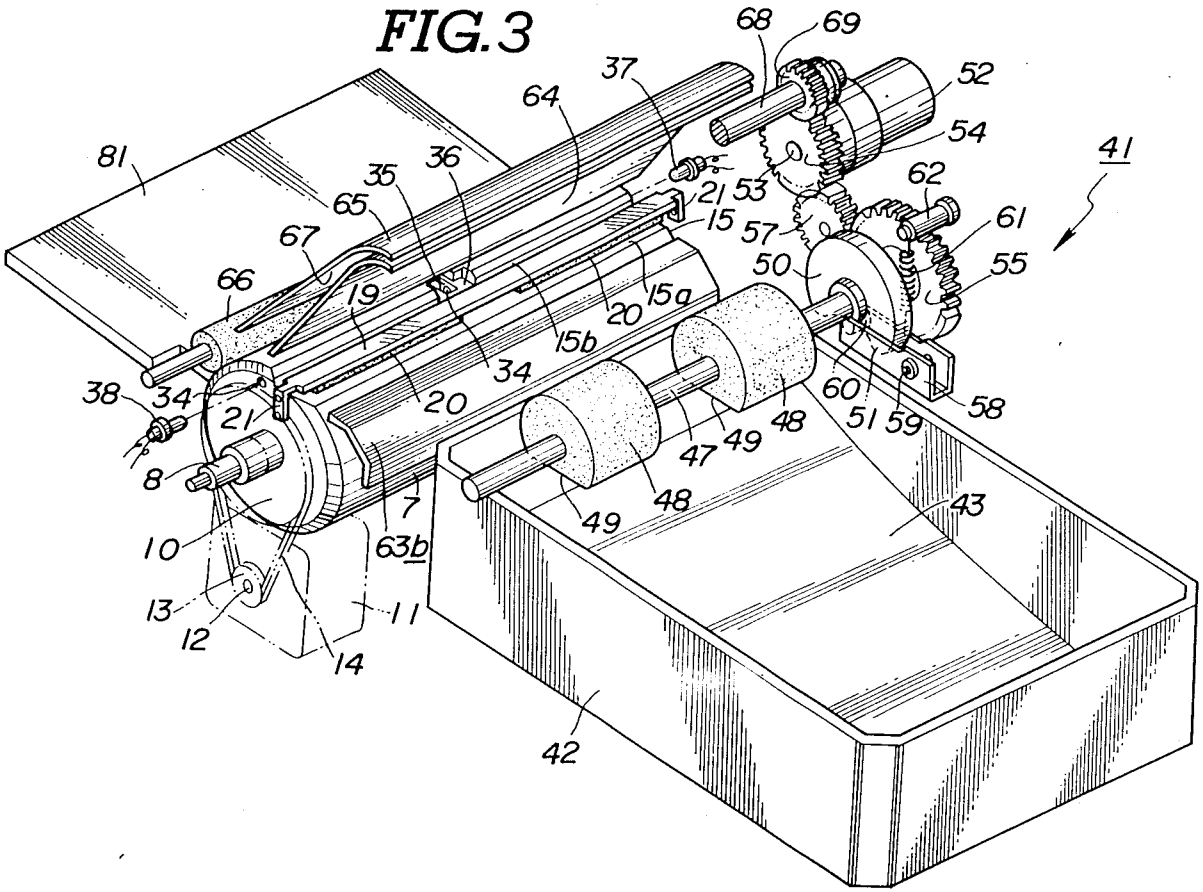
FIG. 3 is a perspective view of a paper feeding and ejecting device according to an embodiment of this invention, and which is shown applied to the thermal printing apparatus of FIG. 2.
Figure 8:
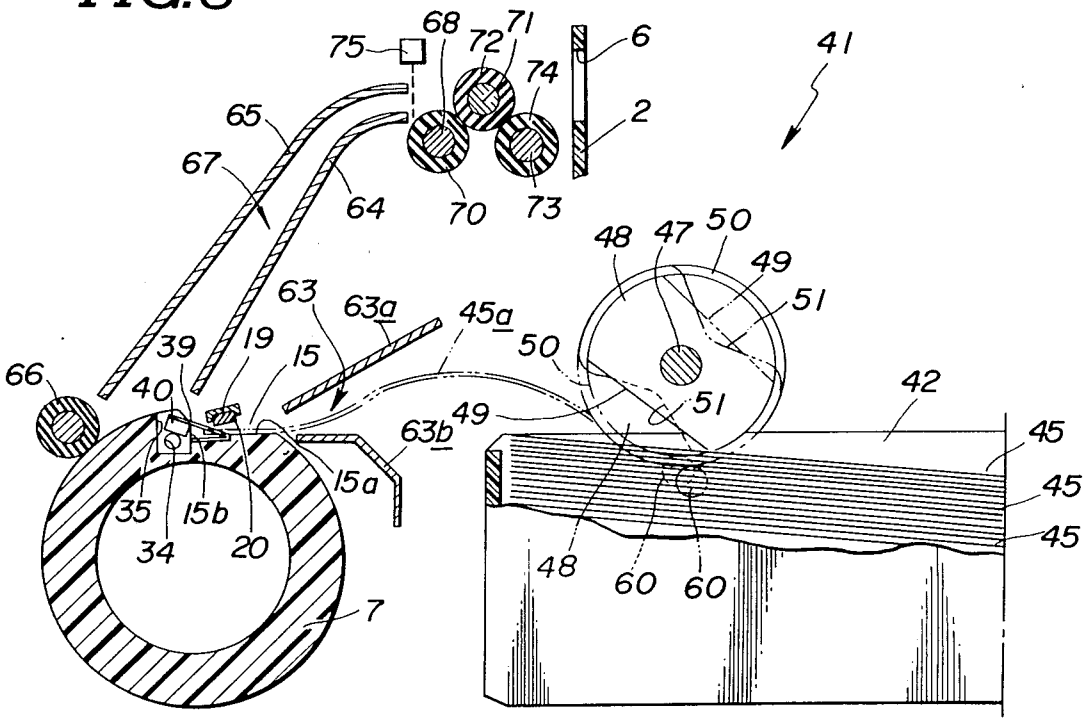
FIG. 8 is an enlarged diagrammatic sectional view corresponding to a portion of FIG. 5 and illustrating the operation of the device embodying this invention in feeding a paper sheet from a tray or magazine into contact with a chucking or gripping seat provided on the peripheral surface of the platen.

A light transmitting bore 34 (FIGS. 3,5 and 7–10) extends axially through platen 7 adjacent stop surface 15*b* of seat 15. At approximately the mid-portion of platen 7 between opposite ends of the latter, there is an enlarged recess 35 which intercepts bore 34 and communicates with a cutout 36 in stop surface 15*b* of seat 15, as best shown in FIG. 3. A light emitting device 37 and a light receiving or photo-sensitive member or sensor 38 are suitably mounted so as to be arranged coaxially at the opposite ends of bore 34 when platen 7 is in its initial or stand-by position. Thus, with platen 7 in its stand-by position, light emitted from device 37 is received by sensor 38 through bore 34 only so long as the latter is not intercepted or blocked by a shutter plate 40 extended into recess 35 as shown in FIG. 10. As shown in detail in FIG. 8, shutter plate 40 is mounted at the free end of one arm of a substantially V-shaped leaf spring 39 extending in cutout 36 and having its other arm secured on surface 15*a* of seat 15. Normally, the two arms of leaf spring 39 are angularly spaced from each other, as shown in FIG. 8, so as to raise shutter plate 40 within recess 35 out of the path of light directed through bore 34. However, when the leading end portion of a paper sheet 45 is moved onto surface 15*a* of seat 15, as hereinafter described in detail, such leading edge portion of the paper sheet 45 acts against the normally V-shaped leaf spring 39 so as to press together the arms thereof, with the result that shutter plate 40 is moved further into recess 35 for blocking the passage of light through bore 34. Therefore, it will be appreciated that, with platen 7 in its stand-by position, the interruption of the reception of light by sensor 38 from device 37 as a result of the movement of shutter plate 40 to its operative position in line with bore 34 is effective to indicate that a paper sheet 45 has been fed to seat 15.

Figure 5:
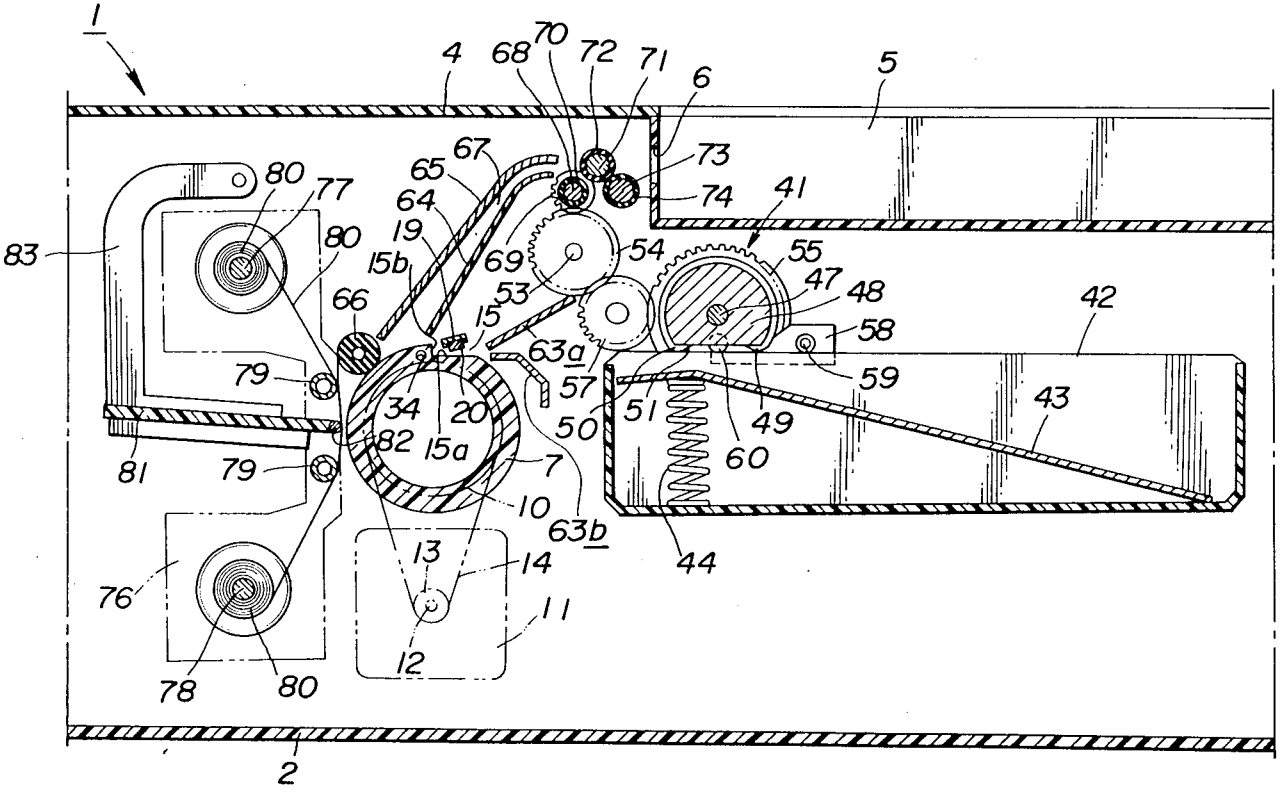
FIG. 5 is a sectional view taken along the line 5—5 in FIG. 4.

In the paper feeding and ejecting device according to this invention, an automatic paper feed mechanism 41 is provided and is shown in FIGS. 3–5 to include a tray or magazine 42 for receiving a stack of paper sheets 45, and which is removably mounted within cabinet 2 at a position below the recess or compartment 5 for receiving printed sheets 45 (FIG. 5). The tray or magazine 42 is generally in the form of an upwardly opening box provided with a movable bottom 43 which is urged upwardly by a spring 44 adjacent a side of magazine 42 which is proximate to platen 7. Therefore, when paper sheets 45 to be printed are arranged in a stack in magazine 42, as in FIG. 8, movable bottom 43 and spring 44 are effective to maintain the uppermost sheet 45 in the stack approximately at a uniform level, particularly at the side of the magazine 42 proximate to platen 7 and from which the paper sheets 45 are successively fed from the magazine 42.

Paper feeding mechanism 41 is provided with an auxiliary frame 46 (FIG. 4) arranged above the position of magazine 42 within cabinet 2, and such auxiliary frame 46 is shown to extend horizontally and to have a generally U-shaped configuration so as to open in the direction toward platen 7. A paper feed roller shaft 47 is arranged parallel to platen 7 with its opposite end portions journalled, in the sides of auxiliary frame 46 so as to be disposed above the side of magazine 42 which is proximate to platen 7. A paper feeding roller 48 is formed in section fixed at axially spaced locations on shaft 47, and at least the outer peripheral portions of the sections of paper feeding roller 48 are formed of rubber or other material having a high coefficient of friction in respect to paper. The sections of paper feeding roller 48 are shown to be part cylindrical in configuration so as to have chordal surface portions 49 of reduced radius which face downwardly toward magazine 42 in a standby position of the paper feeding roller 48. Shaft 47 is vertically positioned in respect to magazine 42 so that, in such standby position of the paper feeding roller 48, the uppermost sheet of paper 45 in the stack of paper sheets 45 urged upwardly by movable wall 43 and spring 44 will not firmly contact peripheral surface portions 49 of the paper feeding roller 48. However, when the paper feeding roller 48 is turned from the stand-by position thereof, movable bottom wall 43 and spring 44 in magazine 42 are effective to press the uppermost sheet 45 of paper in the stack against the cylindrical peripheral surface portions of roller 48 so as to cause feeding of such uppermost sheet 45 in response to turning of shaft 47.

A locating cam 50 is fixed to the rear end portion of shaft 47 so as to be rotatable with feeding roller 48. The cam 50 is approximately heart-shaped and has a peripheral surface with a portion thereof in the form of a circular arc, and with the remainder of said peripheral surface of cam 50 being in the form of a substantially V-shaped indentation 51, as particularly shown in FIG. 9. Further, locating cam 50 is angularly located on shaft 47 so that its V-shaped indentation 51 will face in the same direction as the chordal or reduced radius portions 49 of feeding roller 48.

Figure 6:
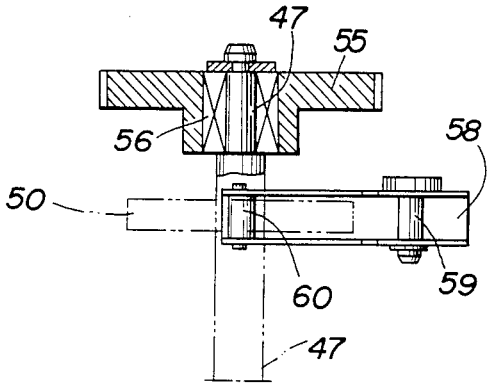
FIG. 6 is an enlarged plan view, partly cut away and in axial section, of a portion of the drive for a paper feeding roller and of a locating device therefor, and which are included in the device appearing in FIGS. 3 and 4.

A reversible roller drive motor 52 is secured to the main frame member 9 at the rear of the printing apparatus 1 and has a forwardly directed output shaft 53 on which a drive gear 54 is secured. A driving gear 55 for the paper feeding mechanism 41 is mounted on shaft 47 and is rotatably coupled to the latter by a one-way clutch indicated at 56 in FIG. 6, and which is operative to transmit torque from driving gear 55 to shaft 47 only in the clockwise direction, as viewed in FIGS. 8–10, that is, only in response to operation of roller drive motor 52 in its forward direction. An intermediate gear 57 is in meshing engagement with gears 54 and 55 (FIGS. 4 and 5) for transmitting rotational force from drive gear 54 on the shaft 53 of motor 52 to driving gear 55.

A locating device for cooperation with cam 50 in determining the stand-by position of paper feeding roller 48 is shown to include an arm 58 pivotally mounted, at one end, on a support shaft 59 carried by auxiliary frame 46 and positioned so that arm 58 extends under locating cam 50. A cam follower roller 60 is mounted on arm 58 adjacent the free end portion of the latter and is urged against the periphery of cam 50 by a spring 61 connected between arm 58 and an anchor pin 62 located on auxiliary frame 46 above arm 58 so as to yieldably urge the latter to pivot in the upward direction. Therefore, when cam follower roller 60 engages any portion of the V-shaped indentation 51 of cam 50, the force of spring 61 is effective to urge shaft 47 to a position in which the center of V-shaped indentation 51 engages roller 60 for establishing the stand-by position of paper feeding roller 48.

Figure 9:
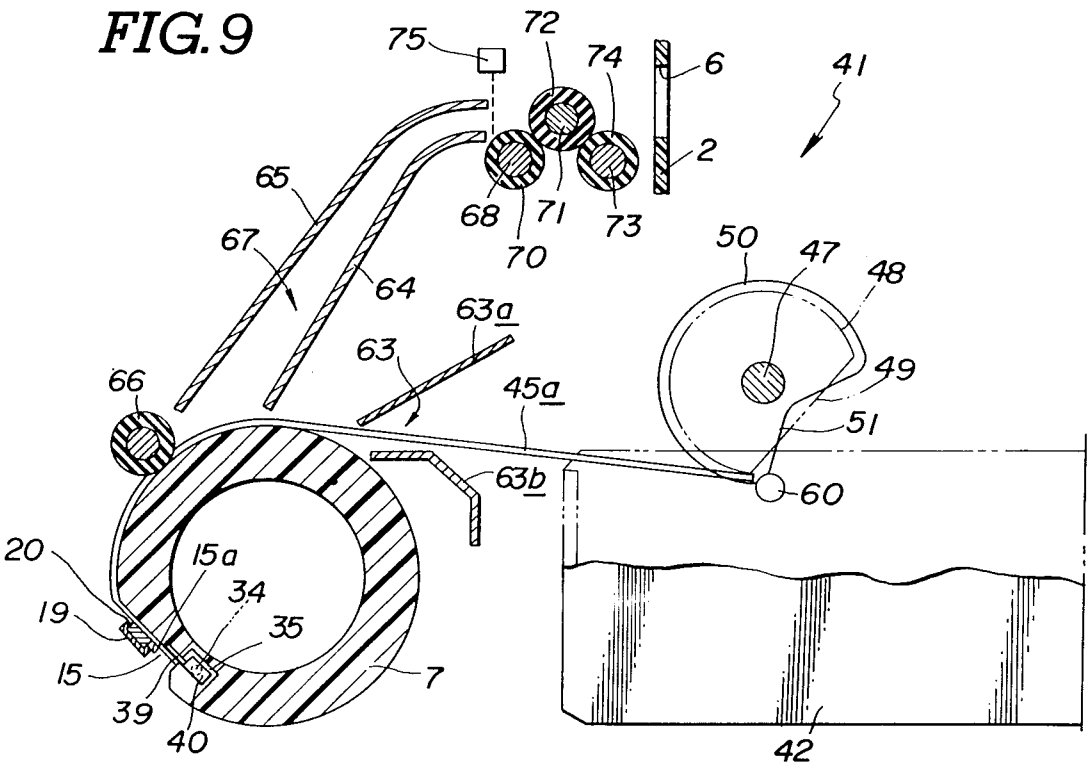
FIG. 9 is a view similar to that of FIG. 8, but illustrating a later stage in the operation of the device during which a paper sheet, gripped at its leading edge on the chucking seat of the platen, is being wrapped about the peripheral surface of the platen during a printing operation.
Figure 10:
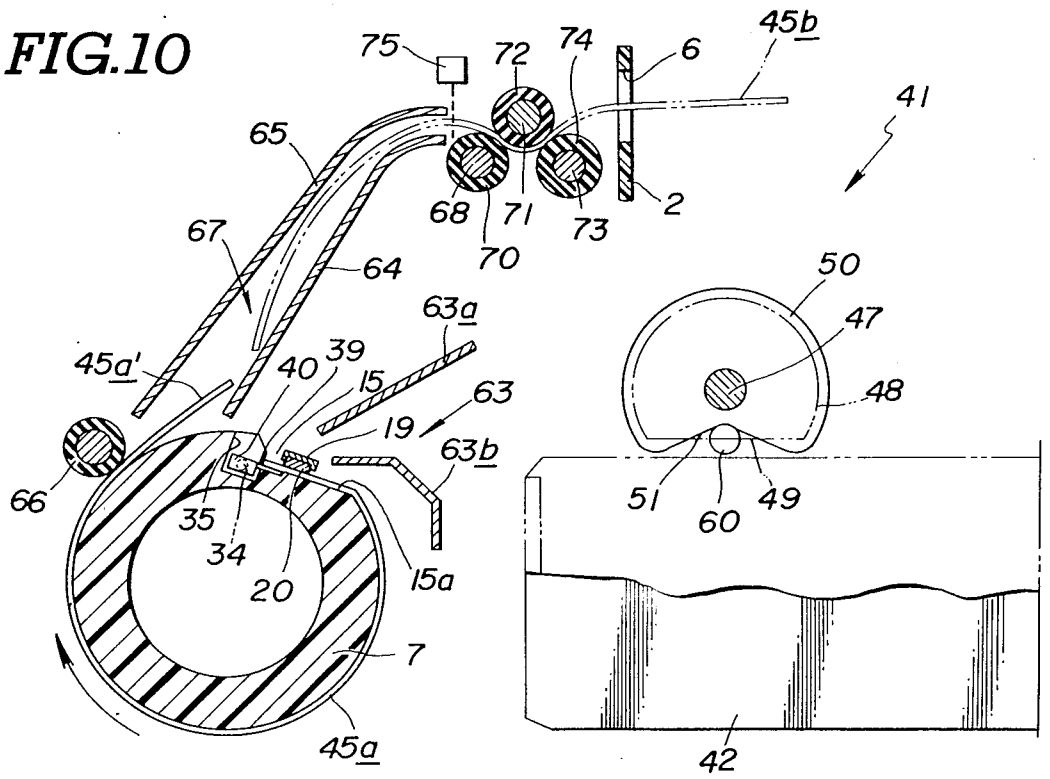
FIG. 10 is another view similar to that of FIGS. 8 and 9, but showing the operation of the device according to this invention in ejecting a sheet after the printing thereof.

As shown particularly in FIGS. 8–10, upper and lower paper feeding guide plates **63*a* and 63*b* extend between magazine 42 and platen 7. Lower guide plate 63*b* extends to the peripheral surface of platen 7 at a level corresponding to surface 15*a* of seat 15 in the stand-by position of the platen 7. Upper guide plate 63*a* converges with guide plate 63*b* in the direction toward platen 7 for defining a passageway 63 between plates 63*a* and 63*b* through which the paper sheets 45 may be fed in succession from magazine 42 to the seat 15 on platen 7** in its initial or stand-by position.

Two paper ejecting guide plates 64 and 65 which are spaced from each other extend upwardly from the upper portion of platen 7 to define a paper ejecting path or passageway 67 having a paper entrance at its lower end adjacent the peripheral surface of platen 7 at a location on the latter spaced in the counterclockwise direction of rotation of platen 7, as viewed in FIGS. 8–10, from the location on platen 7 to which the feeding path or passageway 63 extends. A roller 66 is disposed below the lower edge of paper ejecting guide plate 65 and is in rolling contact with the peripheral surface of platen 7. Ejecting guide plates 64 and 65 are inclined upwardly with progressively decreasing distances therebetween, and the upper end portions of plates 64 and 65 are curved toward ejecting slot 6. The terminal end portion of plate 65 is disposed above the corresponding end portion of plate 64 to define a slot therebetween through which a paper sheet 45 being ejected can exit from passageway 67 in the direction toward slot 6 opening into the compartment 5 at the top of cabinet 2.

The paper feeding and ejecting device for a printing apparatus in accordance with this invention is further shown to have ejecting roller means linked with the feeding rollers 48 and being operative for ejecting a printed sheet of paper 45 from passageway 67 through slot 6. More particularly, such ejecting roller means is shown to include an ejecting roller drive shaft 68 disposed adjacent the terminal end edge of guide plate 64 and having its ends rotatably supported by main frame members 9. An ejecting roller driving gear 69 is fixed on shaft 68 and meshes with gear 54 on the output shaft 53 of roller drive motor 52. A first driven ejecting roller 70 is provided in sections suitably fixed on shaft 68 at regular intervals along the latter and engageable with the underside of a paper sheet 45 as the latter exits from ejecting passageway 67. An idler ejecting roller shaft 71 having an idler roller 72 provided in sections thereon at spaced apart intervals, and a second driven ejecting roller shaft 73 having a second driven ejecting roller 74 provided in sections thereon at spaced apart intervals are positioned in succession between drive shaft 68 and ejecting slot 6, with the ends of shafts 71 and 73 being suitably rotatably supported by main frame members 9. As shown, shaft 73 is at approximately the same level as shaft 68 while shaft 71 is at a higher level. Further, shafts 68, 71 and 73 are spaced from each other so that the sections of rollers 72 on shaft 71 are in rolling contact with corresponding sections of rollers 70 and 74 on shafts 68 and 73 so as to be driven by the latter. As shown particularly in FIG. 4, an endless belt 100 desirably extends about pulleys (not shown) fixed on shafts 68 and 73 so that shaft 73 and roller 74 thereon will be positively driven through belt 100 from the ejecting drive shaft 68, as well as through the successive rolling contacts between rollers 70,72 and 74. It will also be appreciated that at least the outer peripheral portions of ejecting rollers 70,72 and 74 are formed of a material, such as rubber, having a high coefficient of friction with respect to paper. Thus, as shown particularly in FIG. 10, rollers 70 and 74 cooperate with roller 72 so that, as a paper sheet **45*b* exits from passageway 67, the paper sheet 45*b* is gripped between such ejecting rollers 70, 72, 74 and is driven out of slot 6. Further, the paper sheet 45*b*, in traveling from passageway 67 to slot 6 is at least partially wrapped about roller 72 in a direction opposed to that in which such sheet 45*b* previously wound around platen 7 during its printing, thereby removing any curvature of the sheet 45*b* resulting from the winding thereof on the platen 7** during printing.

As shown particularly in FIGS. 8–10, a second sensor or paper sheet detector 75 is located at the exit from paper ejecting passageway 67 for detecting when a paper sheet **45*b* being ejected has fully emerged from between guide plates 64 and 65. The sensor or detector 75 may be photosensitive, for example, may be comprised of a light emitting device and a photo-sensitive device, similar to the previously described elements 37 and 38, and being arranged so that the photo-sensitive device receives light from the light emitting device only when the sheet 45*b* being ejected therebetween has fully emerged from ejecting passageway 67**.

In the thermal printing apparatus 1 with which the above-described paper feeding and ejecting device according to this invention is shown associated, a cassette 76 containing an ink ribbon or web 80 (FIGS. 2 and 5) is removably mounted within cabinet 2. As particularly shown in FIG. 5, the cassette 76 has the ink web or ribbon 80 wound on a supply reel 77 and a take-up reel 78 rotatably disposed within upper and lower portions of the cassette housing. The ink ribbon or web 80 between reels 77 and 78 is positioned by vertically spaced apart guides 79 so as to accurately locate a run of the ink web or ribbon 80 therebetween adjacent the peripheral surface of platen 7 at the side of the latter remote from magazine 42. A layer or coating of ink or dye is provided on the surface of ribbon or web 80 which faces toward platen 7 at the run of the ribbon or web 80 between guides 79.

A thermal head 81 includes a heat generating assembly 82 and is supported by arms 83 suspended from main frame members 9. As is already known, heat generating assembly 82 is formed by a large number of resistive heat generating elements (not shown) arranged in an array extending parallel to the axis of platen 7 and being selectively heated or energized in response to a suitably supplied printing signal so as to effect the selective heat transfer of heat or dye from ribbon 80 to a sheet of paper 45 wrapped about the peripheral surface of platen 7 and moving with the latter past the printing station defined by thermal head 81.

Figure 11:
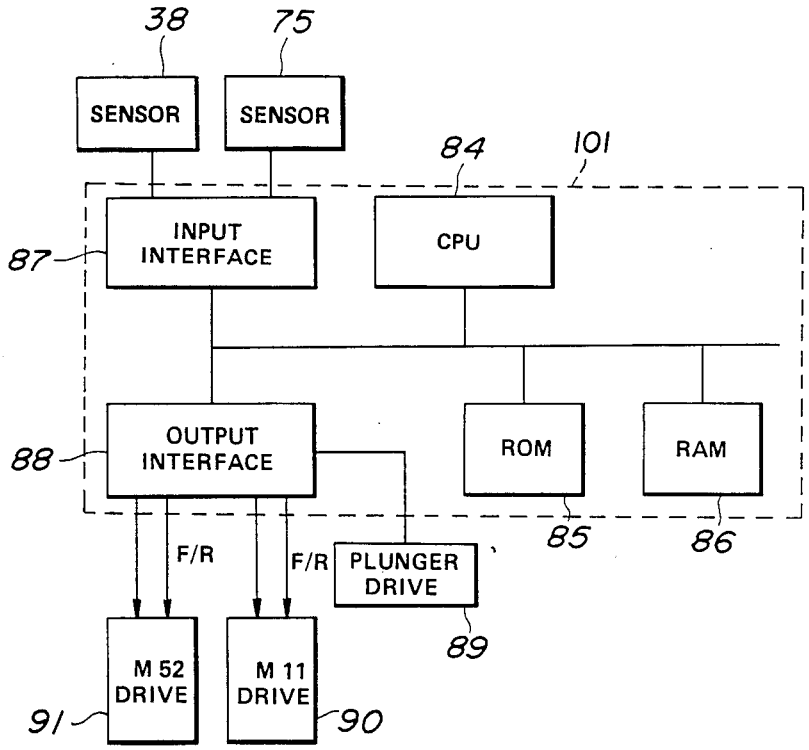
FIG. 11 is a block diagram of a control circuit including a micro-processor for controlling the operations of the printing apparatus having a paper feeding and ejecting device according to this invention.

Referring now to FIG. 11, it will be seen that a system for controlling the paper feeding and ejecting operations in the printing apparatus 1 may desirably comprise a microprocessor 101 consisting of a central processing unit or CPU 84 conventionally associated with memory, for example, a ROM 85 and a RAM 86, and with an input circuit or interface 87 and an output circuit or interface 88. As shown, input interface 87 may receive sensor inputs from light receiving element or detector 38 and detector 75, respectively. Output interface 88 is shown to provide a control signal to a plunger energizing or drive circuit 89 for energizing solenoid 31. Output interface 88 further provides control signals to drive circuits 90 and 91 for motors 11 and 52, respectively. Such control signals from output interface 88 to drive circuits 90 and 91 determine both the periods of operation of the respective motors 11 and 52 and also the directions of such operation.

The operations of the printing apparatus 1 having the above-described paper feeding and ejecting device according to an embodiment of this invention will now be described with reference to the timing charts of FIGS. 12A–12H and the flow chart of FIG. 13.

Prior to initiation of an operating cycle of apparatus 1, platen 7 and paper feeding roller 48 are in their stand-by positions shown on FIG. 5. In such stand-by position of paper feeding roller 48, cam follower roller 60 engages the center of the V-shaped indentation 51 in the periphery of locating cam 50, as shown on FIG. 10. Further, solenoid 31 is initially de-energized so that control lever 25 is urged by spring 33 to its normal position shown in full lines in FIG. 7. Therefore, with platen 7 being initially in its stand-by position and control lever 25 being initially in its normal position, extension 26 on control lever 25 engages pin 18 for angularly displacing support arm members 16A and 16B to the position shown in full lines on FIG. 7 for moving chuck or gripping member 19 to its released position spaced upwardly from surface 15*a* of seat 15.

Figures 12A, 12B, 12C, 12D, 12E, 12F, 12G, 12H:
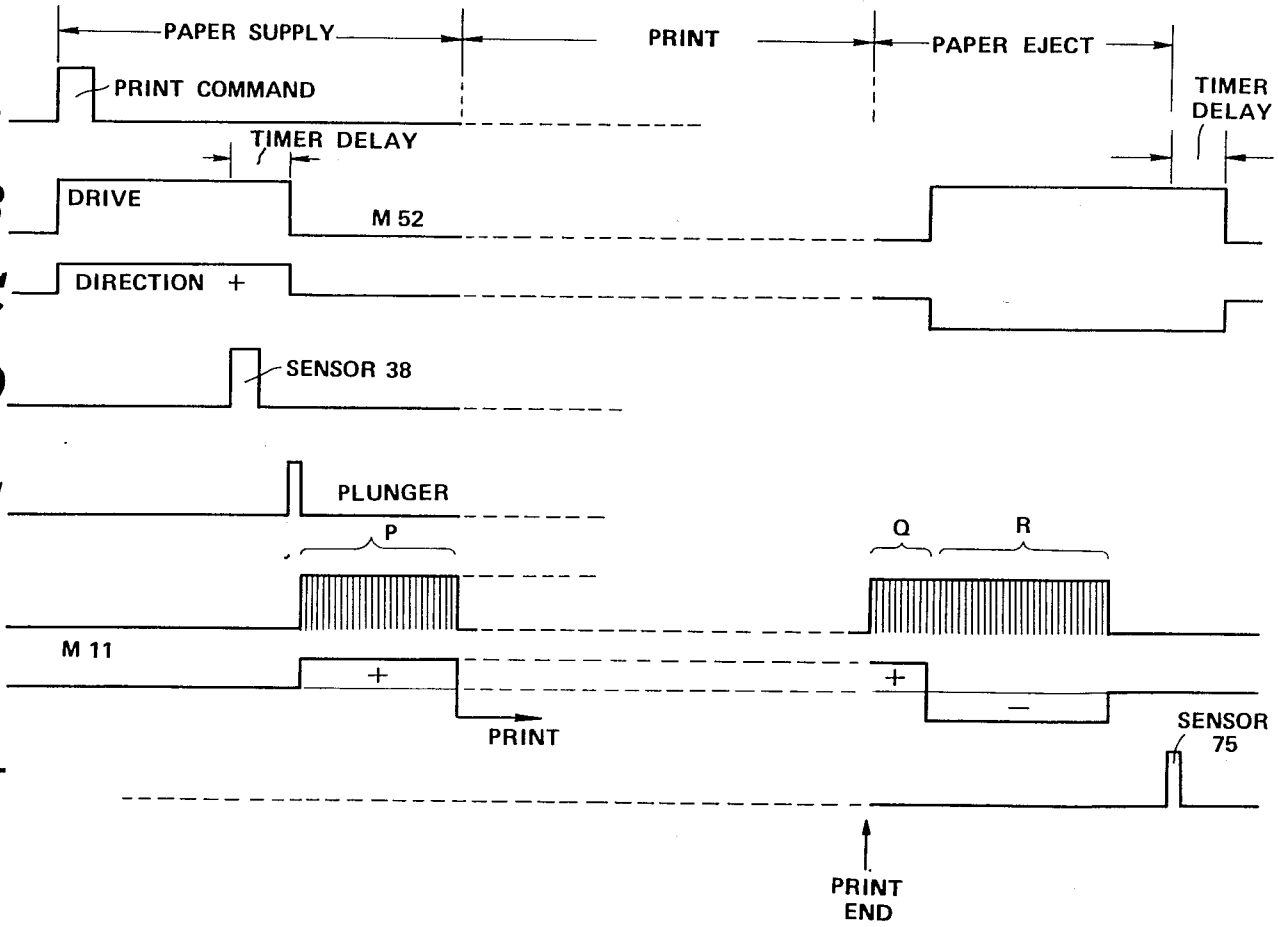
FIGS. 12A–12H are timing charts to which reference will be made in explaining the operation of the control circuit of FIG. 11.

A printing operation is initiated by the operator manually actuating a corresponding push-button provided on a control panel 92 (FIG. 2) of printing apparatus 1 and, as a result thereof, a print command pulse (FIG. 12A) is suitably gemerated. As shown in FIG. 13, the microprocessor 101 of the previously described control system responds to the occurrence of the print command in step 93*a* to cause drive circuit 91 to effect operation of motor 52 (FIG. 12B) in the forward direction (FIG. 12C), as in step 93*b*. In response to such operation of drive motor 52, paper feed roller 48 is rotated in the clockwise direction from the stand-by position shown in FIG. 5. When paper feed roller 48 reaches the position shown in full lines in FIG. 8, that is, when the part-cylindrical peripheral surface portion of paper feed roller 48 is first brought into contact with the uppermost paper sheet 45 in magazine 42 the paper sheets 45 in the stack are displaced downward a small distance against the pressure of coil spring 44. Therefore, there is frictional contact between the uppermost paper sheet 45 and feed roller 48 and continue rotation of the latter in the clockwise direction from the position shown in FIG. 8, causes the uppermost paper sheet 45 to be propelled thereby out of magazine 42 and through passageway 63 toward platen 7, for example, as indicated in dot-dash lines at 45*a* in FIG. 8. As paper feed roller 48 is rotated to the position indicated by dot-dash lines in FIG. 8, the leading end portion of sheet 45*a* is propelled thereby between chuck surface 15*a* of seat 15 on the platen 7 and the released gripping member 19, with the leading end portion of the paper sheet deflecting spring 39 so as to cause shutter plate 40 to interrupt the transmission of light through bore 34. Therefore, the light sensitive element or sensor 38 detects the arrival of the leading end portion of sheet 45*a* on seat 15 of the platen 7, as indicated in FIG. 12D. In response to such detection by sensor 38 of the arrival of the leading end of a paper sheet 45*a* from magazine 42 at seat 15 on platen 7, as in step 93*c* in FIG. 13, the microprocessor 101 halts the operation of motor 52, as in step 93*e*, after a suitably timed delay indicated in step 93*d*. Such delay in halting the operation of motor 52 in the forward direction, as indicated in FIGS. 12B and 12C, ensures that the driving of paper sheet 45*a* by paper feed roller 48 will continue until the leading end of such sheet 45*a* comes into secure contact with the locating or stop surface 15*b* of seat 15.

Figure 13:
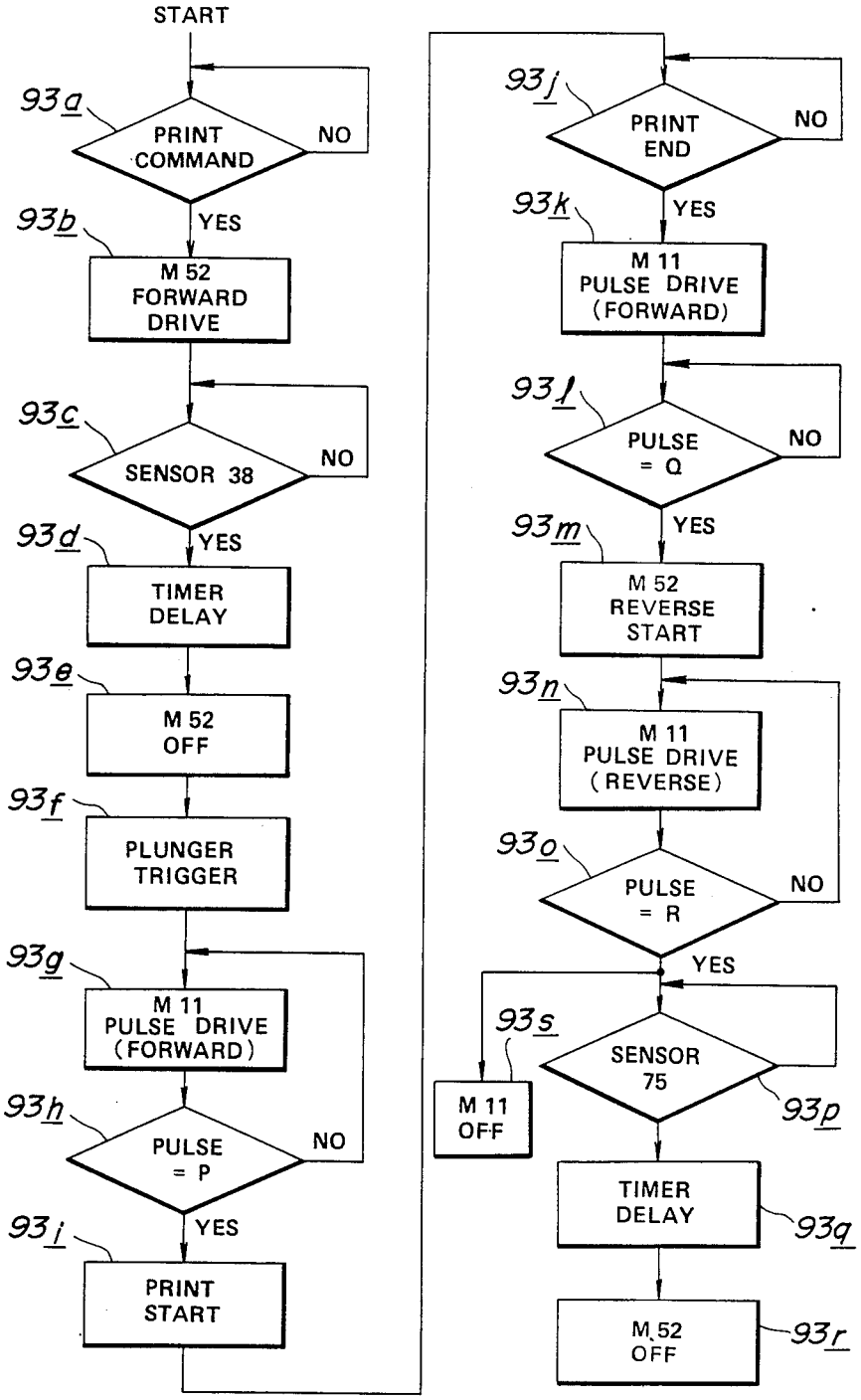
FIG. 13 is a flow chart for the microprocessor to which reference will also be made in explaining the operations of the control circuit.

When the forward operation roller drive motor 52 is actually stopped, the microprocessor 101 triggers the energizing of plunger or solenoid 31, as indicated in FIG. 12E and in step 93*f* in FIG. 13. As a result of such energizing of solenoid 31, control lever 25 is moved to its disengaged position 25′ indicated in broken lines in FIG. 7, thereby to release pin 18 and to permit springs 22 to move gripping member 19 to its engaged position for gripping or chucking the leading end portion of the paper sheet 45*a* on seat 15.

It will be noted that, during the turning of paper feed roller 48 to the position shown in dot-dash lines in FIG. 8, the corresponding turning of locating cam 50 has caused the cam follower roller 60 to come into engagement with the circular portion of the cam periphery. When cam follower roller 60 is thus engaged with the circular portion of the periphery of cam 50, such engagement does not substantially resist or interfere with further turning of paper feed roller 48.

Immediately after the triggering of solenoid 31 for causing the gripping of the leading end of a paper sheet 45*a* to platen 7, as described above, forward drive pulses are supplied to platen drive motor 11, as indicated in FIGS. 12F and 12G and in step 93*g* in FIG. 13.

As a result of operation of motor 11 in the forward direction, platen 7 is turned in the printing or counterclockwise direction, as viewed on FIG. 9, so as to progressively wrap the paper sheet 45*a* about the peripheral surface of platen 7. During the initial winding of paper sheet 45*a* on the surface of platen 7, the trailing end portion of that paper sheet 45*a* is pulled out of magazine 42. Due to the continued frictional engagement of the trailing end portion of paper sheet 45*a* with paper feed roller 48, roller 48 is eventually turned to the position shown on FIG. 9 in which cam follower roller 60 again comes into engagement with the V-shaped indentation 51 in cam 50. Thereafter, the action of spring 61 on arm 58 supporting cam follower 60 causes the continued rotation of cam 50 and roller 48 in the clockwise direction for return of roller 48 to the stand-by position shown in FIG. 10.

Accordingly, paper feed roller 48 is positively driven or rotated by roller drive motor 52 only until the leading end portion of a paper sheet 45*a* is fed thereby into the seat 15 on platen 7 and, thereafter, continued rotation of feed roller 48 back to its stand-by position is achieved first by frictional engagement of roller 48 with the paper sheet 45*a* being wound about the driven platen 7 and then by the rotational force on roller 48 resulting from the action of cam follower roller 60 against the indentation 51 in cam 50.

It will be seen that the return of paper feed roller 48 to its initial or stand-by position is achieved securely and accurately without the use of an additional sensor for detecting the return of roller 48 to its stand-by position. Such additional sensor would be required to halt the operation of motor 52 upon the return of roller 48 to its stand-by position in the event that motor 52 was employed for effecting the full return of roller 48 to its stand-by position.

Drive pulses provided by drive circuit 90 for causing motor 11 to drive platen 7 in the forward or printing direction, that is, in the counterclockwise direction in FIG. 9, are suitably counted or detected, as in step 93*h* in FIG. 13. When the number of detected drive pulses from circuit 90 equals the value P, thereby indicating that the paper sheet 45*a* chucked on the surface of platen 7 has attained a position relative to thermal head 81 at which actual printing on the paper sheet 45*a* is to commence, the microprocessor 101 provides a suitable control signal to start the printing operation, as in step 93*i* in FIG. 13. During such printing operation, platen 7 is conventionally rotated in the forward or printing direction by the operation of motor 11 and the resistive heating elements of heat generator 82 in head 81 are selectively energized for transferring ink from ribbon 80 to the paper sheet 45*a* in accordance with predetermined printing signals.

When the completion of the actual printing operation is sensed, as in step 93*j*, drive circuit 90 is made operative to cause motor 11 to further drive platen 7 in the forward or printing direction, as in step 93*k*. During such further turning of platen 7 in the forward direction, the trailing end portion 45*a'* of the sheet 45*a* which has been printed is moved beyond the lower edge of guide plate 64 and into the entrance to eject guide passageway 67, as in FIG. 10. The number of drive pulses from drive circuit 90 to motor 11 for effecting such further rotation of platen 7 after the completion of the printing operation is suitably counted or detected, as in step 93*l*. When the number of such drive pulses attains the value Q, the microprocessor 101 causes drive circuits 91 and 90 to effect operation of roller drive motor 52 and platen drive motor 11 in their reverse or paper ejecting directions, as in steps 93*m* and 93*n* in FIG. 13. During the turning of platen 7 in its paper ejecting direction indicated by the arrow in FIG. 10, the end portion 45*a'* of the printed paper sheet 45*a* remote from the end chucked against seat 15 is propelled upwardly through ejecting guide passageway 67 as the paper sheet 45*a* progressively unwound from the platen 7.

The number of drive pulses provided by drive circuit 90 for operating motor 11 in the reverse or paper sheet ejecting direction is counted, as in the step 93*o*, and, when the counted number of drive pulses attains the value R, operation of motor 11 in the reverse direction is. halted (FIGS. 12F and 12G) as indicated in the step 93*s* in FIG. 13. It will be appreciated that the number of pulses R is selected so that, at the completion of the turning of platen 7 in the reverse or clockwise direction, as viewed in FIG. 10, platen 7 will be restored precisely to its stand-by or initial position shown in FIGS. 5 and 8.

Prior to such return of platen 7 to its stand-by position, the end portion 45*a'* of sheet 45*a* being ejected will project out of the exit end of ejecting passageway 67 so as to be gripped between paper ejecting roller 72 and rollers 70 and 74 which are being respectively rotated in the counterclockwise and clockwise directions as a result of the operation of roller drive motor 52 in the reverse direction. Thus, paper ejecting rollers 70,72 and 74 continue the ejecting movement of a printed paper sheet 45*a* from ejecting guide passageway 67 through slot 6 and into the adjacent compartment 5 for receiving the printed sheets 45.

As shown in FIG. 12E, the plunger or solenoid 31 remains de-energized throughout the return or paper ejecting rotation of platen 7 in the direction of the arrow in FIG. 10 back to its stand-by position, so that control lever 25 remains in its operative position shown in full lines in FIG. 7. Thus, as platen 7 nears its stand-by position, that is, after the end portion 45*a'* of the printed paper sheet 45*a* being ejected has been engaged by ejecting rollers 70, 72 and 74, pin 18 on actuating arm 16*b* comes to the position shown in dot-dash lines at 18' in FIG. 7 and is acted upon by the triangular cam-like projection 27 on control level 25. Such cam-like projection 27 causes angular deflection of actuating arm 16*b* as pin 18 moves over projection 27 so as to momentarily move chucking member 19 to its released position spaced from surface 15*a* of seat 15. As a result of the foregoing, the end portion of printed sheet 45*a* that was previously secured to the platen 7 by chucking member 19 is freed from the latter to permit the continued ejecting movement of the sheet through ejecting passageway 67 by the action of rollers 70,72 and 74, as indicated in respect to the paper sheet 45*b* shown in dot-dash lines in FIG. 10. Of course, when platen 7 is actually returned to its stand-by position, pin 18 on actuating arm 16*b* will again be engaged by the upward extension 26 of arm 25*b* of control lever 25 for again moving chucking member 19 to its released position in preparation for the arrival from magazine 42 of the leading end portion of the next paper sheet 45 at the stand-by position of the platen 7.

Further, as shown in FIG. 13, the counting or detection of R drive pulses for platen drive motor 11 in step 93*o* also causes actuation of sensor or detector 75 at the exit end of ejecting guide passageway 67, as in step 93*p*. When sensor 75 detects the emergence from passageway 67 of the trailing end portion of the sheet 45*b* which is then being propelled by ejecting rollers 70,72 and 74, the microprocessor 101 responds to a corresponding signal from sensor 75 (FIG. 12H) to halt the operation of motor 52 in the reverse direction, as in step 93*r* after a predetermined time delay, as indicated in FIGS. 12B and 12C and in step 93*q*. Such time delay ensures that rollers 70,72 and 74 will continue to rotate in the directions for propelling the paper sheet 45*b* being ejected completely through slot 6 and into compartment 5 for the printed sheets.

As earlier noted, and as is clearly apparent in FIG. 10, when the sheet 45*b* propelled between rollers 70,72 and 74 in the course of being ejected through slot 6, the paper sheet 45*b* is bent or partly wrapped about roller 72 in the direction opposite to the curvature given to the paper sheet while being printed against the surface of platen 7. Therefore, any residual curvature of the printed paper sheet is removed therefrom during the ejecting thereof.

By way of summary, it will be seen that the described paper feeding and ejecting device for a printing apparatus according to an embodiment of the invention comprises a platen 7 provided with a chucking member 19 for gripping an end of a paper sheet 45 to the platen surface and being selectively rotated in a forward direction during a printing operation and in a reverse direction for ejecting a paper sheet 45 after the printing thereof, a paper feeding roller 48 rotatable from a stand-by position for feeding a paper sheet 45 from a magazine 42 therebelow to the platen 7 and having a peripheral surface portion 49 of reduced radius which is out of contact with paper sheets 45 in the magazine 42 in the stand-by position of the feeding roller 48, a locating cam 50 rotatable with the feeding roller 48, a locating member 60 yieldably urged against the cam 50 for restoring the feeding roller 48 to its stand-by position, a roller drive motor 52 rotated in a forward direction for a paper feeding operation which is stopped when a leading end portion of a paper sheet 45 is gripped to the platen surface, and rotated in the reverse direction after the paper sheet 45 has been printed, a one-way clutch 56 for transmitting torque from the roller drive motor 52 to the paper feeding roller 48 only when the motor 52 is being driven in the forward direction, and paper ejecting means 68–74 driven in a paper ejecting direction when the roller driving motor 52 is rotated in the reverse direction so as to eject a printed paper sheet 45 from the printing apparatus 1.

By reason of the foregoing arrangement characteristic of the invention, each paper sheet 45 to be printed is automatically fed by feeding roller 48 when the latter is being driven by motor 52, each printed paper sheet 45 is automatically ejected by the paper ejecting rollers 70,72 and 74 while being driven by the same motor 52, but in the opposite direction. Further, since the passageway 63 through which each paper sheet 45 is guided from magazine 42 to platen 7 is separate from the passageway 67 through which each printed paper sheet 45 is ejected, the ejecting operation for removing each printed sheet 45 does not disturb the paper feeding operation by which the next paper sheet 45 is fed to platen 7, with the result that the time required for a complete printing cycle can be substantially reduced.

Furthermore, since the paper feeding roller 48 has a portion 49 of reduced radius which is out of pressure contact with the uppermost sheet of paper 45 in magazine 42 when roller 48 is in its stand-by position, and since the cam follower roller 60 biased against the periphery of locating cam 50 cooperates with the V-shaped indentation 51 in such periphery for automatically urging the return of roller 48 to its stand-by position, the accurate return of roller 48 to its stand-by position can be achieved without the use of an additional sensor therefor.

Although an illustrative embodiment of this invention has been described in detail herein with reference to the accompanying drawings, it is to be understood that the invention is not limited to that precise embodiment, and that various changes and modifications may be effected therein by one skilled in the art without departing from the scope or spirit of the invention as defined in the appended claims.

What is claimed is:

1. A paper feeding and ejecting device for a printing apparatus, comprising:

a platen rotatable in a predetermined direction for winding a sheet of paper therearound during printing of said sheet;

a magazine for storing a stack of paper sheets;

feeding roller means disposed above said magazine and being rotatable for feeding a sheet of paper from the top of said stack toward said platen;

feeding guide means extending between said magazine and said platen for guiding the sheet of paper being fed by said feeding roller means in a feeding path leading to said platen at a predetermined location on the peripheral surface of the platen;

said platen including in a peripheral surface thereof a cutout extending thereacross to define a chucking seat which, in an initial position of said platen, is disposed at said predetermined location for receiving a leading end portion of a sheet of paper propelled by said feeding roller means in said feeding path, and further comprising electrically energizable sheet gripping means on said platen for securing said leading end portion of a sheet on said chucking seat;

paper sensing means arranged in said platen for sensing the presence of a sheet of paper in said cutout and providing an energizing signal for actuating said sheet gripping means ejecting roller means linked with said feeding roller means and being operative for ejecting a sheet of paper after the printing thereof;

ejecting guide means for guiding the sheet of paper to be ejected to said ejecting roller means from said platen, said ejecting guide means having an entrance adjacent said peripheral surface of the platen at a location thereon spaced in said predetermined direction of rotation of the platen from said predetermined location to which said feeding path extends;

drive means for said platen including a platen drive motor operative to rotate said platen in said predetermined direction during printing and in the opposed direction during ejecting of a sheet which has been printed, and a reversible roller drive motor, means for rotating said ejecting roller means from said roller drive motor, and means including one-way clutch means for rotating said feeding roller means from said reversible roller drive motor only in response to operation of said reversible roller drive motor in one of its reversible directions and in which said roller drive motor is operated in said one direction during said feeding of a sheet of paper from said stack toward said platen, and said roller drive motor is operated in the opposite one of said reversible directions for ejecting of a sheet of paper after the printing thereof.

2. A paper feeding and ejecting device according to claim 1; in which said ejecting roller means includes three parallel ejecting rollers arranged successively in rolling contact with each other so as to at least partially wrap the sheet of paper being ejected about the middle one of said three rollers in a direction opposed to that in which said sheet was wound around said platen during the printing thereof for removing any curvature of the sheet resulting from said winding of the sheet during printing.

3. A paper feeding and ejecting device according to claim 1; in which said ejecting roller means includes three parallel ejecting rollers arranged successively in rolling contact with each so as to at least partially wrap the sheet of paper being ejected about the middle one of said three rollers in a direction opposed to that in which said sheet was wound around said platen during its printing for removing any curvature of the sheet resulting from the winding thereof on the platen during printing.

4. A paper feeding and ejecting device according to claim 1; in which said feeding roller means includes a feeding roller having a peripheral surface portion of reduced radius which is out of contact with the top of said stack when said feeding roller is in a standby position with said reduced radius surface portion facing downwardly, a locating cam rotatable with said feeding roller, and a locating member yieldably urged against said cam for restoring said feeding roller to said standby position after each feeding of a sheet from the top of said stack.

5. A paper feeding and ejecting device according to claim 4; in which said cam has a peripheral surface with a portion in the form of a circular arc and with the remainder of said peripheral surface in the form of a substantially V-shaped indentation, and said locating member engages said peripheral surface and is yieldably urged toward the axis of rotation of said cam with said feeding roller, said standby position of the feeding roller being defined by engagement of said locating member in the center of said V-shaped indentation.

6. A paper feeding and ejecting device according to claim 1; in which, upon the securing of a leading end of a sheet on said chucking seat, said drive means for said platen rotates said platen in said predetermined direction during printing with said platen coming to rest with the other end of the sheet in said entrance to said ejecting guide means at the completion of printing, whereupon said drive means for said platen rotates the platen in the opposed direction for propelling a printed sheet through said ejecting guide means toward said ejecting roller means; and further comprising control means for at least partially releasing said sheet gripping means when said other end of a sheet propelled through said ejecting guide means is engaged by said ejecting roller means.

7. A paper feeding and ejecting device according to claim 6; in which said sheet gripping means includes a chucking member mounted on said platen for movement between engaged and released positions, means urging said chucking member to said engaged position, and an actuating member rotatable with said platen and being displaceable relative thereto for moving said chucking member to said released position; and in which said control means includes a control lever pivotally mounted adjacent said platen and having a normal first position in which said control lever displaces said actuating member for releasing said chucking member with said platen in said initial position and a second position in which said control lever is withdrawn from engagement by said actuating member, means for momentarily moving said control lever to said second position upon receipt of said leading end portion of a sheet on said chucking seat with said platen in said initial position, and abutment means on said control lever engageable with said actuating member for said at least partial releasing of the sheet gripping means as said platen is rotated in said opposed direction toward said initial position thereof.

8. A paper feeding and ejecting device for a printing apparatus, comprising:

a rotatable platen having a peripheral cutout extending thereacross for receiving an end portion of a paper sheet and an electrically energizable sheet gripping means for gripping said end portion of a paper sheet;

sensor means arranged in said rotatable platen proximate said peripheral cutout for sensing the presence of an end portion of a paper sheet and producing a signal to energize said sheet gripping means;

platen drive means for rotating said platen in one direction during a printing operation and in the opposite direction during ejecting of a paper sheet after the printing thereof;

a magazine for storing a stack of paper sheets;

a paper feeding roller rotatably mounted above said magazine and having a peripheral surface with a major portion which, in cross-section, has the shape of a circular arc, for frictional feeding engagement with a sheet at the top of said stack, and a minor portion of reduced radius which is out of frictional engagement with said top of the stack when said feeding roller is in a standby position with said minor reduced radius portion facing downwardly;

a locating cam rotatable with said feeding roller and having a peripheral surface with an indented portion;

a locating member yieldably urged against said peripheral surface of the cam and engageable with said indented portion thereof for restoring said feeding roller to said standby position after each feeding of a sheet from said stack;

a reversible drive motor;

transmission means including a one-way clutch between said motor and said feeding roller for transmitting a rotational force to said feeding roller only when said drive motor is operated in one direction;

control seans for said drive motor causing operation of said drive motor in said one direction for feeding of a sheet from said stack by said feeding roller until an end portion of the sheet is engageable by said gripping means on the platen, and causing operation of said drive motor in the opposite direction at the completion of said printing operation; and paper ejecting means also driven by said drive motor and being operative in response to operation of said drive motor in said opposite direction for ejecting a printed sheet separated from said platen.

9. A paper feeding and ejecting device according to claim 8; in which said ejecting means includes three parallel ejecting rollers arranged successively in rolling contact with each other so as to at least partially wrap the sheet of paper being ejected about the middle one of said three rollers in a direction opposed to that in which said sheet was wound around said platen during the printing thereof for removing any curvature of the sheet resulting from said winding of the sheet during printing.

10. A paper feeding and ejecting device according to claim 8; in which said peripheral cutout defines a chucking seat which, in an initial position of said platen, is disposed for receiving a leading end portion of a sheet of paper frictionally fed by said feeding roller, and said sheet gripping means is disposed on said platen for securing said leading end portion of a sheet on said chucking seat.

11. A paper feeding and ejecting device according to claim 10; in which said platen drive means is operative, upon the securing of a leading end of a sheet on said chucking seat, to rotate said platen in said one direction during printing with said platen coming to rest with the other end of the sheet engageable by said ejecting means at the completion of printing, whereupor said platen drive means rotates the platen in said opposite direction for propelling a printed sheet to said ejecting means; and in which means are provided for at least partially releasing said sheet gripping means when said other end of a sheet is engaged by said ejecting means.

12. A paper feeding and ejecting device according to claim 11; in which said sheet gripping means includes a chucking member mounted on said platen for movement between engaged and released positions, means urging said chucking member to said engaged position, and an actuating member rotatable with said platen and being displaceable relative thereto for moving said chucking member to said released position; and in which said means for releasing the sheet gripping means includes a control lever pivotally mounted adjacent said platen and having a normal first position in which said control lever displaces said actuating member for releasing said chucking member with said platen in said initial position and a second position in which said control lever is withdrawn from engagement by said actuating member, means for momentarily moving said control lever to said second position upon receipt of said leading end portion of a sheet on said chucking seat with said platen in said initial position, and abutment means on said control lever engageable with said actuating member for said at least partial releasing of the sheet gripping means as said platen is rotated in said opposite direction toward said initial position thereof.

* * * * *